United States Patent [19]

Smyrl et al.

[11] 4,428,428

[45] Jan. 31, 1984

[54] TOOL AND METHOD FOR GRAVEL PACKING A WELL

[75] Inventors: Kenneth E. Smyrl, Marrero, La.; Bobby G. Redd, Hobbs, N. Mex.

[73] Assignee: Dresser Industries, Inc., Dallas, Tex.

[21] Appl. No.: 333,511

[22] Filed: Dec. 22, 1981

[51] Int. Cl.[3] ..... E21B 43/04; E21B 34/08

[52] U.S. Cl. ..... 166/278; 166/51; 166/319; 166/317

[58] Field of Search ..... 166/278, 276, 51, 317, 166/319, 321; 137/70

[56] References Cited

U.S. PATENT DOCUMENTS

| | | | |
|---|---|---|---|
| 2,224,538 | 12/1940 | Eckel et al. | 166/21 |
| 3,072,204 | 1/1963 | Brown | 175/230 |
| 3,627,046 | 12/1971 | Miller et al. | 166/278 |
| 3,710,862 | 1/1973 | Young | 166/278 |
| 3,818,986 | 6/1974 | Abney | 166/51 |
| 3,901,318 | 8/1975 | Fortenberry | 166/278 |
| 3,987,854 | 10/1976 | Callihan et al. | 166/278 |
| 4,044,832 | 8/1977 | Richard et al. | 166/278 |
| 4,192,375 | 3/1980 | Maly | 166/51 |

OTHER PUBLICATIONS

Completion and Service Packer Systems-Guiberson.

*Primary Examiner*—Ernest R. Purser
*Assistant Examiner*—Thuy M. Bui
*Attorney, Agent, or Firm*—W. R. Peoples

[57] ABSTRACT

A gravel packing tool includes a differential piston sleeve normally covering an auxiliary return port through the wash pipe located above an annular seal of a sand screen liner. The seal engages the wash pipe sealing against pressure communication between upper and lower sand screen sections in the liner. A shear pin connecting between the sleeve and the wash pipe holds the sleeve in its port closing position until the pressure differential between the inside and outside of the wash pipe causes the sleeve to shift into a second position breaking the pin and exposing the port to establish an auxiliary path for liquid to return through the wash pipe. A spring acting between the sleeve and the wash pipe urges the sleeve back into its closing position when the pressures inside and outside the wash pipe begin to equalize.

8 Claims, 4 Drawing Figures

TOOL AND METHOD FOR GRAVEL PACKING A WELL

TECHNICAL FIELD

The present invention relates generally to the process of preparing a well for the production of oil or gas and specifically relates to the tools and processes employed in gravel packing a well so as to avoid the production of sand along with the oil or gas.

BACKGROUND ART

In the production of oil or gas from certain types of formations, sand also may be produced and, if the flow of sand from the well is not controlled in some manner, apparatus within the well will almost certainly be damaged by abrasion of the sand. Gravel packing is one method of sand control in which particularly sized particles of a suitable material such as gravel or glass beads or the like, all referred to herein as gravel, are used to filter sand from the produced fluid before flowing into a production string in the well. Generally speaking, gravel packing is accomplished by pumping a liquid slurry into the well with gravel from the slurry being collected at least in part within the casing between the inside wall thereof and a sand screen liner so as to filter sand from the fluid before the latter enters the production string.

One prior method and apparatus for gravel packing a well to prepare the well for production is illustrated schematically and described briefly in Guiberson 1979/80 General Catalog at pages 64 and 65. Briefly, as shown in that catalog, a tubing string carrying a packer is run into a well to position a sand screen liner carried by the packer adjacent the formation to be produced. For running in the well, the packer is latched to the tubing string by way of a slurry tool which is connected to the lower end of the tubing string. The tool includes a latch tube for connection to the packer and a wash pipe telescoped through the latch tube. The wash pipe protrudes from the lower end of the packer into the sand screen liner which includes upper and lower sand screen sections separated from each other by an annular seal. The latter engages the lower end portion of the wash pipe to seal against fluid communication through the interior of the liner between the upper and lower sand screen sections.

With the foregoing arrangement, gravel packing is accomplished after setting the packer by pumping a gravel slurry down the tubing string, into an upper section of the wash pipe, past the packer, and through a crossover valve into the annulus between the well casing and the sand screen liner. The gravel in the slurry is collected at the bottom of the well with the liquid being filtered from the gravel by being driven through the lower sand screen section and into the open lower end of a lower section of the wash pipe. This return liquid flows upwardly through the lower section of the wash pipe, past the crossover valve, through the annular area between the latching tube and the upper section of the wash pipe, and exits the annular area through a circulation valve flowing into an upper well annulus located between the tubing string and the casing above the packer. Thereafter, the return liquid flows toward the top of the well and through the upper annulus ultimately to be dumped from the well.

Periodically, during the packing process, the circulation valve may be closed and high pressure applied through the slurry to compact the gravel collected at the bottom of the well and also to drive some of the gravel into the formation through perforations in the casing. Once gravel is packed in the bottom of the well to some desirable level above the upper sand screen, flow through the well may be reversed for liquid to exit the bottom of the wash pipe as the slurry tool is pulled upwardly. This circulates excess slurry out of the tubing string and helps free the lower end of the wash pipe in the event some deposits have collected in the liner. As the wash pipe is pulled free, the liquid from the upper well annulus, enters the annular area between latch tube and the upper section of the wash pipe, flows downwardly past the crossover valve and into the lower section of the wash pipe. The liquid exits the lower end of the wash pipe and, once the end passes above the annular seal between the sand screen sections, the liquid flows upwardly through the crossover valve and into the upper section of the wash pipe then into the tubing string and to the well head, driving out any excess slurry remaining in the tubing string and thereby completing the gravel packing operation except for pulling the cleaned tubing string from the well to remove the slurry tool.

DISCLOSURE OF INVENTION

The present invention contemplates an improvement in a tool and method of gravel packing generally described above through the provision of a second flow path for returning filtered slurry liquid to the well head to assure adequate gravel packing adjacent the upper sand screen section. More particularly, the present invention contemplates an improvement in the construction of the slurry tool so as to automatically cause filtering of the slurry liquid through the upper sand screen section in the event the pressure drop through the gravel packed in the bottom of the wash pipe exceeds a preselected magnitude. Specifically herein, the invention resides in the provision of an auxiliary return port in the wash pipe above the annular seal and a differential piston sleeve which normally closes the auxiliary return port but which slides into an open position exposing the auxiliary return port when the pressure outside of the wash pipe exceeds the pressure inside by the aforementioned preselected magnitude. With the auxiliary return port exposed, return liquid may flow from the lower casing annulus into the wash pipe along a second path through the upper sand screen section rather than through a longer path leading through the compacted gravel and the lower sand screen section into the bottom of the lower section of the wash pipe.

Additionally, invention resides in the novel construction of the lower section of the wash pipe so as to include a frangible connection between the differential piston sleeve and the lower section of the wash pipe to keep the sleeve from shifting into its open position prior to the pressure outside of the wash pipe exceeding the pressure inside by the aforementioned preselected magnitude and in the provision of a spring for urging the piston sleeve back into its closed position when the outside pressure exceeds the inside pressure by a second preselected magnitude substantially lower than the first mentioned preselected magnitude so as to insure that the port is closed for reverse flow of liquid through the well such as when removing the slurry tool.

The foregoing and other advantages of the present invention will become more apparent from the following description of the best mode of carrying out the invention when taken in conjunction with the accompanying drawings.

BEST MODE OF CARRYING OUT THE INVENTION

Figure 1:
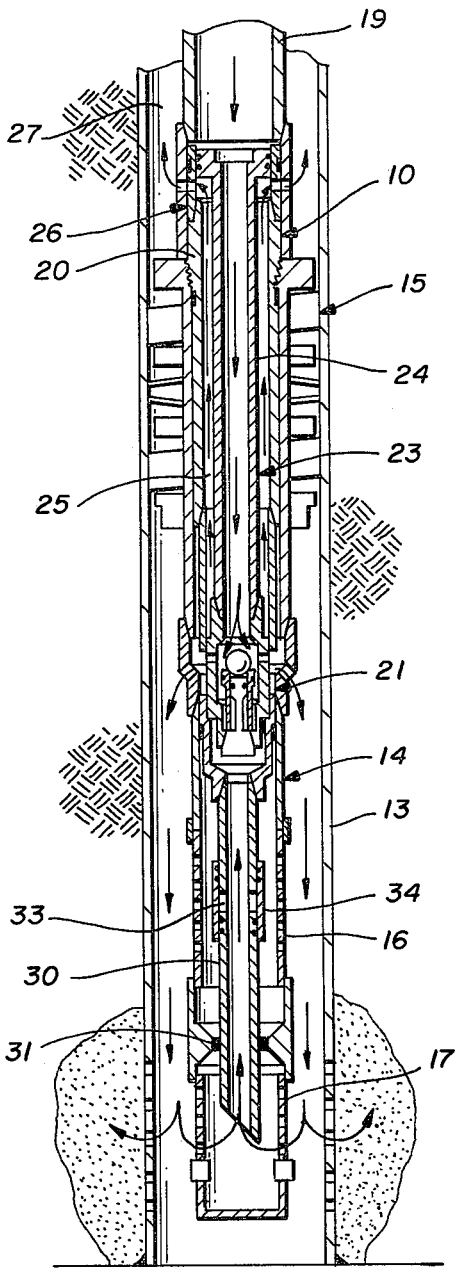
FIGS. 1 and 2 are schematic elevational views of a well having disposed therein a well tool embodying the novel features of the present invention, with parts of the tool being shown in moved positions.
Figure 2:
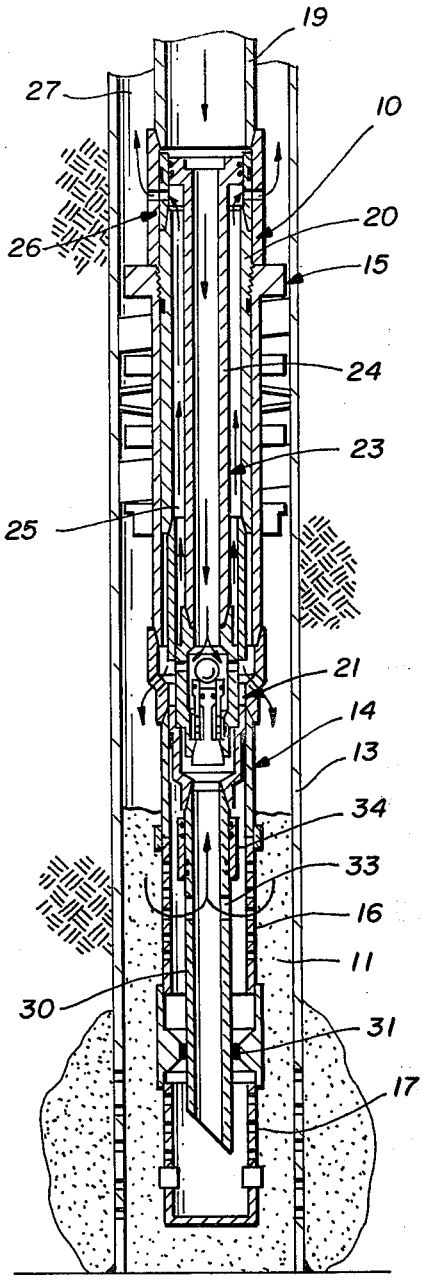

As shown in the drawings, the present invention is embodied in a tool 10 and method for gravel packing an annulus 11 in a well between the well casing 13 and a liner 14. Herein, the liner is connected to a packer 15 anchored in the well casing and includes upper and lower sand screen sections 16 and 17. The packer connected with the lower end of a tubing string 19 by means of a latch tube 20 which extends through the packer connecting with a crossover valve 21 disposed beneath the packer. Telescoped into the latch tube is an elongated wash pipe 23 having an upper end section 24 and a lower end section 30. The upper end section 24 connects to and is sealed within the tubing string 19 so as to define an annular area 25 between the latch tube and the upper section of the wash pipe. At the upper end of this area, a circulation valve 26 selectively provides for communication between an upper well annulus 27 between the tubing string 19 and the casing 13. At the lower end of the upper section 24 of the wash pipe, the crossover valve provides fluid communication between the inside of the well tubing and the lower well annulus 11. Within the liner, the lower end portion of the lower section 30 of the wash pipe is engaged by an annular seal 31 so as to prevent fluid communication within the liner 14 between the upper and lower sand screen sections 16 and 17.

In delivering a gravel slurry to the bottom of the well for packing around the liner 14, the slurry is pumped down the tubing string 19, into the upper section 24 of the wash pipe, through the crossover valve 21, and outwardly into the lower well annulus 11. Initially, return liquid from the slurry is filtered through the lower sand screen section 17 entering the liner 14 beneath the lower end of the lower section 30 of the wash pipe. Thereafter, the filtered liquid flows upwardly into and through the lower section 30 of the wash pipe and past the crossover valve 21 into the annular area 25. Above the packer 15, the liquid exits the annular area 25 through the circulation valve 26, entering the upper well annulus 27 to flow therein upwardly toward the well head for dumping from the well. Accordingly, gravel is collected in the lower well annulus 11 and, it will be appreciated that as the depth of the gravel increases the pressure of the liquid passing through the collected gravel drops.

In accordance with the present invention, advantage is taken of the pressure differential existing between the inside and the outside of the wash pipe 23 to automatically open an auxiliary return flow path through the upper sand screen section 16 for the return liquid from the slurry to insure that the level of gravel built up in the bottom of the well will extend substantially above the upper sand screen section 16. Herein, this is accomplished by constructing the lower section 30 of the wash pipe 23 to include an auxiliary return port 33 which is closed normally by a differential area piston sleeve 34. The port is located above the annular seal 31 for communication with the lower well annulus 11 through the upper sand screen section 16, and, the sleeve is held against moving into a position opening the port by means of a frangible connection in the form of a shear pin 35 (see FIG. 3). Accordingly, when pressure in the well above the seal 31 and outside of the lower section 30 of the wash pipe exceeds the pressure inside the wash pipe by some preselected magnitude, the frangible connection 35 will shear and the sleeve will shift, opening the port for return liquid to flow into the wash pipe through the upper screen section 16 (see FIG. 4). By virtue of this arrangement, the gravel may be packed assuredly to a level in the well above the upper sand screen section without having to either unlatch and lift the wash pipe 23 to raise the lower end thereof to a point above the seal 31 or to otherwise perform some special procedure such as one requiring a wireline to be run into the well.

Figure 3:
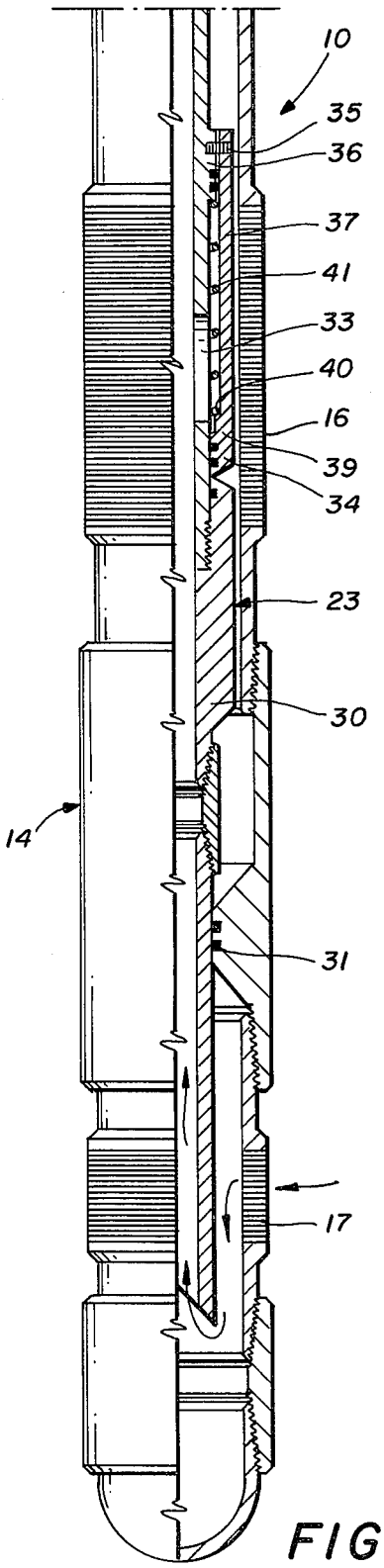
FIGS. 3 and 4 are similar enlarged, fragmentary, combined elevational and cross-sectional views of the exemplary tool showing parts off the tool in relative moved positions.
Figure 4:
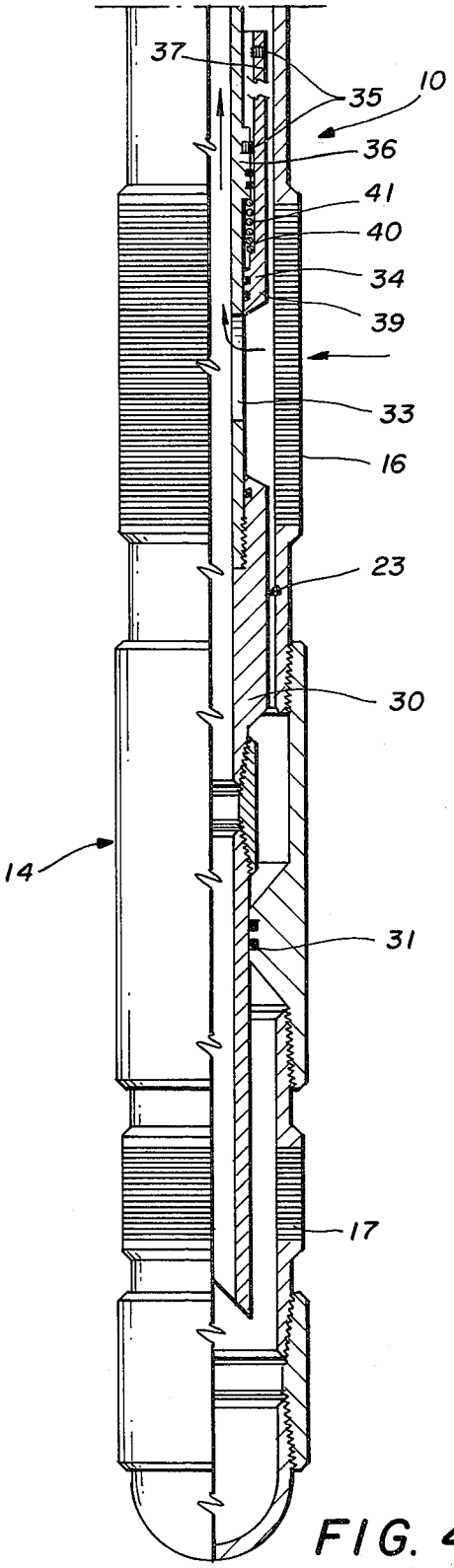

In the present instance, the port 33 is located within the lower section 30 of the wash pipe 23 beneath the crossover valve 21 and above the lower end of the pipe a distance sufficient to locate the port 33 above the seal 31 and substantially adjacent the upper sand screen section 16 when the latch tube 20 is secured to the packer 15. The differential piston sleeve 34 is telescoped over the lower section 30 of the wash pipe normally in a position closing the port as shown in FIG. 3. Herein, an annular land 36 integrally formed with the wash pipe protrudes radially outwardly therefrom above the port 33 and is sealed against the inside of an upper end portion 37 of the sleeve. Beneath the port, radially thicker lower end portion 39 is sealed against the outside of the wash pipe. An inner annular shoulder 40 intermediate the upper and lower end portions 37 and 39 of the sleeve provides a lower abutment for a coil spring 41 while the upper end of the spring rests against the underside of the land 36 so as to urge the sleeve toward its position closing the port 33. Initially holding the sleeve in its closing position is the shear pin 35 and this pin is connected between the radially thinner upper end portion 37 of the sleeve 34 and the pipe land 36.

With the foregoing described arrangement, it will be appreciated that when pumping the slurry into the well increasing pressure is required to drive the slurry liquid through both the gravel collected at the bottom of the well and the lower sand screen section 17 before flowing into the lower end of the wash pipe 23. Accordingly, the pressure inside the wash pipe will be less than the pressure outside. Owing to the exposed area differences between the thinner upper and thicker lower ends of the sleeve as the pressure drop increases, so does the resulting upward force generated on the sleeve. When this force exceeds the combined strengths the shear pin 35 and the spring 37 the pin will be broken and the sleeve will shift upwardly. With the pin broken, the pressure drop required to support the sleeve in its open position, of course, is substantially less thereby allowing the pressure drop across the port 33 itself resulting from liquid flow to be sufficient to maintain the sleeve in its open position. Once a sufficient amount of gravel is packed around the upper sand screen section 16, liquid flow through the well may be reversed, pumping a clean liquid down the upper well annulus 27 and eventually out the lower end of the wash pipe 23. During reversing when flow inwardly through the port 33 ceases, the spring 37 will urge the sleeve back into its closing position. Accordingly, the liquid flowing in the reverse direction through the well will exit the lower end of the wash pipe, allowing the latter to be easily freed from within the liner 14 when pulling the tubing string 19 from the well. Once the lower end of the wash pipe passes above the seal 31 flow is established through the liner and the crossover valve 21 to enter the upper section 24 of the wash pipe. Accordingly, the liquid flowing up the tubing string reverses out any slurry remaining therein to complete the gravel packing operation except for pulling the tubing string 19 from the well and removing the slurry tool 10.

The embodiments of the invention in which an exclusive property or privilege is claimed are defined as follows:

1. In a tool for use in gravel packing an annulus in a well casing between the casing and a liner with upper and lower sand screen sections therein separated by an annular seal acting between the inside of the liner and the outside of a wash pipe which is telescoped into the liner for returning liquid from a gravel slurry pumped into the annulus and filtered at least initially through the lower sand screen before entering the wash pipe for return to the head of the well, wherein the improvement in said tool comprises, a port formed through the wash pipe above the seal, a differential area piston sleeve telescoped onto said wash pipe and being movable from a first position closing said port and toward a second position opening said port in response to a differential pressure of a preselected magnitude existing between the inside and outside of said wash pipe, and means for urging said sleeve into its closing position when said pressures inside and outside wash pipe approach equality.

2. A tool as defined by claim 1 further including a frangible connection between said piston sleeve and said wash pipe, said connection breaking when said differential pressure exceeds said preselected magnitude.

3. A tool as defined by claim 2 wherein said means for urging said sleeve piston comprises a spring acting between said sleeve piston and said wash pipe.

4. In a tool for use in gravel packing an annulus in a well casing between the casing and a liner with upper and lower sand screen sections therein separated by an annular seal acting between the inside of the liner and the outside of a wash pipe which is telescoped into the liner for returning liquid from a gravel slurry pumped into the annulus and filtered at least initially through the lower sand screen before entering the wash pipe for return to the head of the well, wherein the improvement in said tool comprises, a port formed through the wash pipe above the seal, a differential area piston sleeve telescoped onto said wash pipe and being movable from a first position closing said port and toward a second position opening said port in response to a differential pressure of a preselected magnitude existing between the inside and outside of said wash pipe, and releasable means for initially supporting said sleeve in its closing position before said differential pressure exceeds said predetermined magnitude, said means thereafter releasing said sleeve piston to shift into its opening position.

5. A tool as defined by claim 4 further including a spring for urging said piston sleeve back into its closing position when said differential pressure drops to a second preselected magnitude less than said first preselected magnitude.

6. A method for gravel packing an annulus in a well casing between the casing and a sand screen liner having upper and lower sand screen sections sealed from each other and a wash pipe extending therebetween for returning liquid from a gravel slurry pumped into the well, said method comprising:

pumping a gravel slurry down the well and into the annulus between the well casing and the sand screen liner, initially filtering the slurry through the lower sand screen section to cause the gravel therein to collect in the annulus, directing the liquid filtered from the slurry into the wash pipe from beneath the seal between the upper and lower sand screen sections and back to the top of the well, thereafter opening communication from the annulus into said wash pipe through the upper sand screen section automatically when the pressure drop across the gravel collected in the annulus exceeds a preselected magnitude so as to filter the slurry primarily through the upper sand screen section, and directing the liquid filtered through the upper sand screen section into and through the wash pipe above the seal between the sand screen sections and back toward the head of the well.

7. A method for gravel packing as defined by claim 6 wherein said opening communication from the annulus into said wash pipe comprises, opening a port located in said wash pipe above the seal when the pressure outside the wash pipe exceeds the pressure inside the wash pipe by said preselected magnitude.

8. A method for gravel packing as defined by claim 7 further comprising, discontinuing pumping of the gravel slurry down the well, and thereafter pumping another liquid down the well in a reverse direction through the wash pipe, causing the pressure differential between the outside of the wash pipe and the inside of the wash pipe to drop, and closing the port in the wash pipe at a second preselected magnitude when the pressure differential drops to a second preselected magnitude less than the first mentioned preselected magnitude.

* * * * *

Disclaimer 4,428,428.—*Kenneth E. Smyrl*, Marrero, La.; *Bobby G. Redd*, Hobbs, N. Mex. TOOL AND METHOD FOR GRAVEL PACKING A WELL. Patent dated Jan. 31, 1984. Disclaimer filed Feb. 12, 1990, by the assignee, Dresser Industries, Inc.

The term of this patent subsequent to Feb. 1, 1990, has been disclaimed.

[ *Official Gazette May 29, 1990* ]